US005924920A

United States Patent [19]

DeLuca et al.

[11] Patent Number: 5,924,920

[45] Date of Patent: Jul. 20, 1999

[54] FUME HOOD HAVING A BI-STABLE VORTEX

[75] Inventors: Robert A. DeLuca, Patchoque, N.Y.; Robert H. Morris, Wharton, N.J.

[73] Assignees: Flow Safe, Inc.; Lab-Crafters, Inc.

[21] Appl. No.: 09/007,422

[22] Filed: Jan. 15, 1998

Related U.S. Application Data

[60] Provisional application No. 60/035,997, Jan. 22, 1997.

[51] Int. Cl.[6] ..... B08B 15/02

[52] U.S. Cl. ..... 454/62; 454/61

[58] Field of Search ..... 454/61, 62, 56

[56] References Cited

U.S. PATENT DOCUMENTS

| | | | |
|---|---|---|---|
| 4,741,257 | 5/1988 | Wiggin | 454/62 |
| 4,785,722 | 11/1988 | Dollhopf et al. | 454/62 |
| 5,518,446 | 5/1996 | Jacob | 454/61 |
| 5,697,838 | 12/1997 | Morris | 454/62 |

*Primary Examiner*—Harold Joyce
*Assistant Examiner*—Derek S. Boles
*Attorney, Agent, or Firm*—M. Lukacher; R. C. Brown

[57] ABSTRACT

The flow of air through a fume hood is optimized by producing a bi-stable vortex within the vortex chamber of the fume hood regardless of sash movement. A bi-stable fume hood optimizes capture face velocity to minimize backflow of fume laden air through the hood sash opening. This bi-stable vortex fume hood reduces the energy consumption up to sixty percent versus the present day mono-stable vortex fume hoods. The bi-stable vortex fume hood utilizes a vortex pressure control system to reposition top, center, and bottom slot openings of a baffle in the hood. This baffle moves the bi-stable vortex away from the fact when the sash is fully opened and creates a clearing action near the work surface as the sash is closed. The fume hood's airfoil is placed inside the fume hood chamber and the airfoil has multiple entry pattern, one of which turns the vortex up and away from the open sash window. The other creates flow which washes the work surface of the hood. The interior portion of the vortex chamber utilizes a turning vane in order to decrease dynamic losses and increase bi-stable vortex stability.

14 Claims, 9 Drawing Sheets

FUME HOOD HAVING A BI-STABLE VORTEX

This application claims the priority benefit of Provisional Application Ser. No. 60/035,997 filed Jan. 22, 1997.

DESCRIPTION

The present invention relates to ventilated enclosures for containing and preventing the spread of vapors, such enclosures being commonly known as fume hoods, more particularly to fume hoods which are openable to permit to access to the interior, which opening may permit inadvertent escape of fumes to the exterior of the hood.

The first fume hoods were fireplaces used by alchemists. These early day fume hoods had very tall chimneys. The stack height, thermal gradients caused by a fire, and the aspirating effect of the outside wind conditions would create a considerable draft. To increase the draft, early day ventilation engineers (mid 1800's) added gas burning rings in the stack to achieve greater thermo-lift. During the industrial revolution, the gas rings gave way to a mechanical fan. It was about this time that laboratories were becoming better defined. Changes evolved such as adding a front sash instead of a hinged door and airfoil beneath the sash window. In the late 1940's, a back baffle system and streamlined shape entrance was introduced to all fume hoods. A fume hood of the design just described is shown in FIG. 1 and labeled "Prior Art".

Dimensionally, these Prior Art fume hoods were sized so that they could be carried in through an average door, and placed on a 30" wide by 36" high bench with a height limitation due to a nine to ten foot ceiling. Dimensionally, the hoods made today are virtually exactly the same size as were made 50 years ago.

Fume hood performance has always been based on a smoke visualization test, where a smoke bomb is placed within the inside the hood on its work surface and as long as the smoke is not seen exiting the sash face, the hood is considered working properly. The recommended face velocity (the velocity of air flowing into the hood through the sash opening or "face") is between 100 and 150 feet per minute (FPM). For years, fume hood users felt that the higher the face velocity, the better the containing hood. High face velocities began to lose favor in the late 1960's with the introduction of the bypass-air hood (shown schematically in FIG. 2), which introduced air above the sash as the sash was closed. Then in the mid 1980's, a performance tracer gas analysis test was developed to measure the performance of a fume hood and the ability thereof to protect the worker. This test for the first time could quantify actual spillage rates in parts per million (ppm), thereby showing how well a hood does perform in varying operating conditions.

One of the main reasons that this tracer gas performance test was created, was that in an effort to reduce the costly heating ventilation and cooling costs, which increased dramatically in the 1980's, fume hood exhaust volumes were being reduced along with sash window openings to reduce the air conditioning makeup air volume to save energy. Exhaust volumes were reduced either by open loop synchronizing the exhaust valve with sash closing or opening, or by measuring differential pressure and using close-loop systems for controlling the servo exhaust valve. All of these schemes are based on commonly held notions that a constant face velocity provides proper containment as the sash window is manipulated. This assumption is not necessarily true because it fails to address what is the optimum face velocity and therefore, the optimum airflow through the hood to prevent back flow. One of the applicants has developed and improved a vortex control system for fume hoods, illustrated in FIG. 3, and which is the subject of the U.S. Pat. No. 5,697,838, issued to Robert H. Morris on Dec. 16, 1997, which is hereby incorporated herein by reference. Tracer gas studies conducted by Robert H. Morris have shown that the fume hoods are not inherently made safer by using variable volume fixed face velocity control techniques, although energy can be saved through the reduction in the exhaust airflow volume. These tracer gas tests have indicated that the fume hood face velocity is influenced by the internal vortex of the fume hood, and operating variables such as room air distribution, supply air temperature, clutter inside the fume hood, and the location of the fume hood in the lab space. The vortex control system of the U.S. Pat. No. 5,697,838 optimizes the flow of air through a fume hood by dynamically controlling the airflow to provide a stable vortex in the vortex chamber of the hood, which maximizes backflow of fume-laden air through the hood doorway. A highly-sensitive pressure sensor disposed at in the vortex chamber side wall senses minute variations in the vortex pressure indicative of turbulence and sends signal via a transducer to an analog controller, which uses proportional interval and adaptive gain algorithms, to formulate output signals to an actuator which adjusts dampers in the hood system to change the airflow into the vortex chamber.

The present invention is based upon discoveries made while manipulating the slots in the baffle of a fume hood, that the vortex within the fume hood chamber was very easily disrupted by other environmental challenges. The flow conditions in the upper part of the vortex chamber are illustrated by FIG. 4 which is a schematic diagram of the chamber region of a hood. It is shown that a vortex bubble develops on the surface within the upper region of the vortex chamber. The vortex is controlled by a laminar controlling jet along the back baffle surface in the vortex chamber area. This laminar jet stream causes a sustained pressure differential to develop and entrain some of the air surrounding it. The entrained air on the wall side is trapped against the wall while ambient air from the face velocity replaces the entrained air from the opposite side. The result is that the ambient pressure on the side away from the wall and the lower pressure between the jet and the wall. The pressure differential deforms the jet and forms a mono-stable vortex bubble in the region of the lowest pressure. FIG. 5 is a schematic diagram of a fume hood showing this mono-stable vortex.

The vortex in the conventional fume hoods therefore appears to be mono-stable. The vortex will remain stationary on the wall as long as the controlling air jet stream remains laminar. However, if the laminar jet stream becomes disrupted, due to environmental conditions, such as room pressure fluctuations, cross-drafts, fume hood loading and thermal temperature changes of the supply makeup air, the vortex bubble becomes filled and the pressure gradient is lost. The mono-stable vortex becomes chaotic and breaks down. The loss of the vortex bubble is the precursor to fume hood containment failure. The mono-stable vortex cannot re-establish itself until the jet stream is once again laminar.

The present invention provides a fume hood having a bi-stable vortex hood. The term "bi-stable vortex" as used herein refers to a vortex in a hood which is stable with the sash either open or closed. The bi-stable vortex is provided by a baffle arrangement. A bi-stable vortex bubble is produced on the same wall surface as the mono-stable vortex bubble, but is characterized by a much more symmetrical shape and it requires an opposing jet stream to disrupt it and to break down the vortex.

The invention has as a principal feature to use of the bi-stable vortex bubble in a fume hood.

A further feature of the invention is to provide an improved fume hood having a vortex chamber with a hydraulic radius ratio in relationship to the hydraulic radius ratio of the sash window of the hood.

A further feature of the invention is to provide a fume hood having an automatically repositionable baffle, a vortex chamber turning vane, and a multi-three entry airfoil which cooperates in forming a bi-stable vortex in a fume hood.

The invention will become more apparent from the following detailed description when considered with the foregoing description and in connection with the drawings, some of which have been mentioned and which are briefly described as follows.

Figure 1:
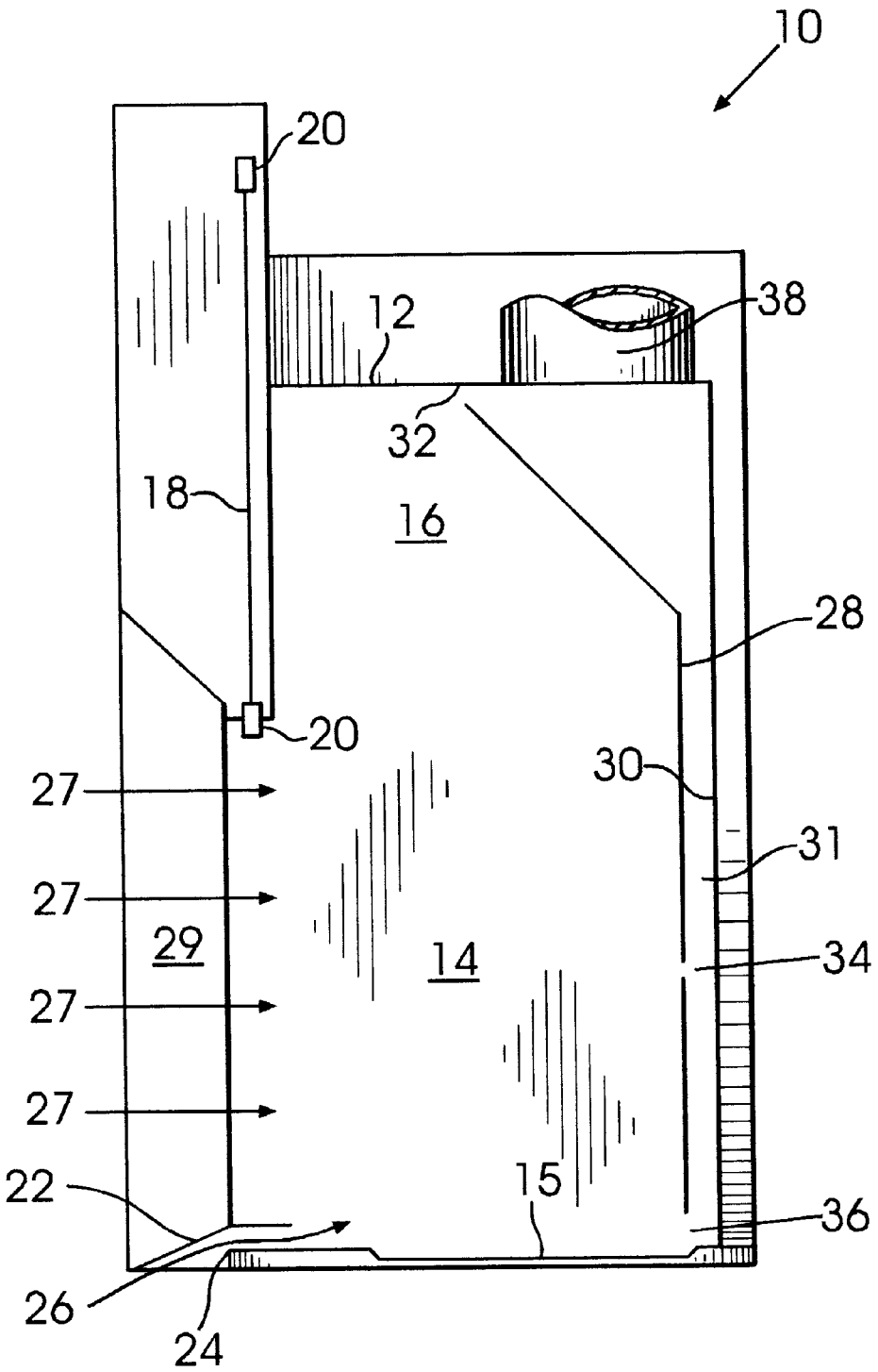
FIG. 1 (PRIOR ART)
FIG. 1 is a schematic diagram showing a standard, conventional (Prior Art) fume hood in elevation.
Figure 3:
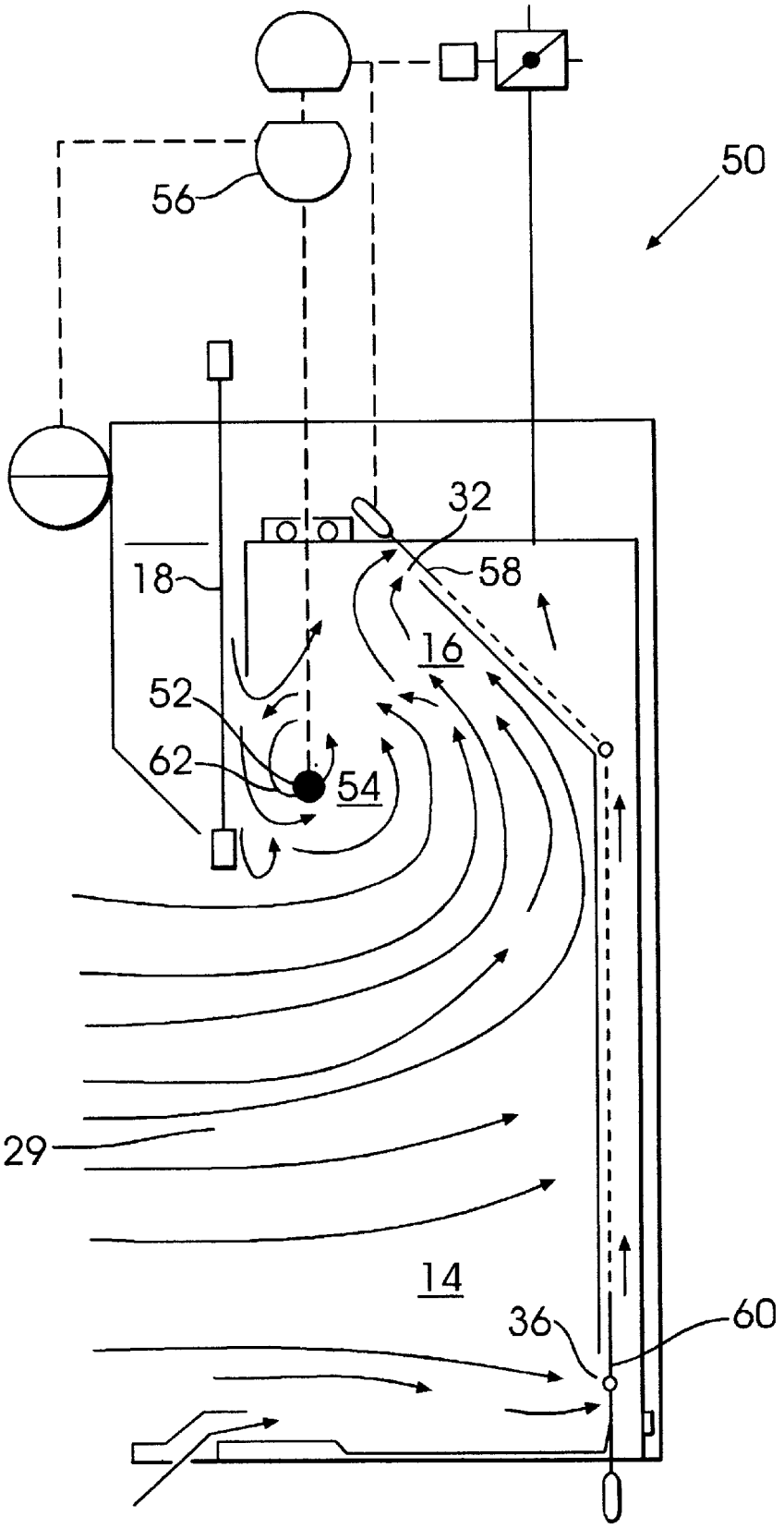

FIG. 3 is a diagram similar to FIG. 1 of a fume hood having a vortex control system in accordance with the invention of the U.S. Pat. No. 5,697,838 incorporated by reference above.

Figure 4:
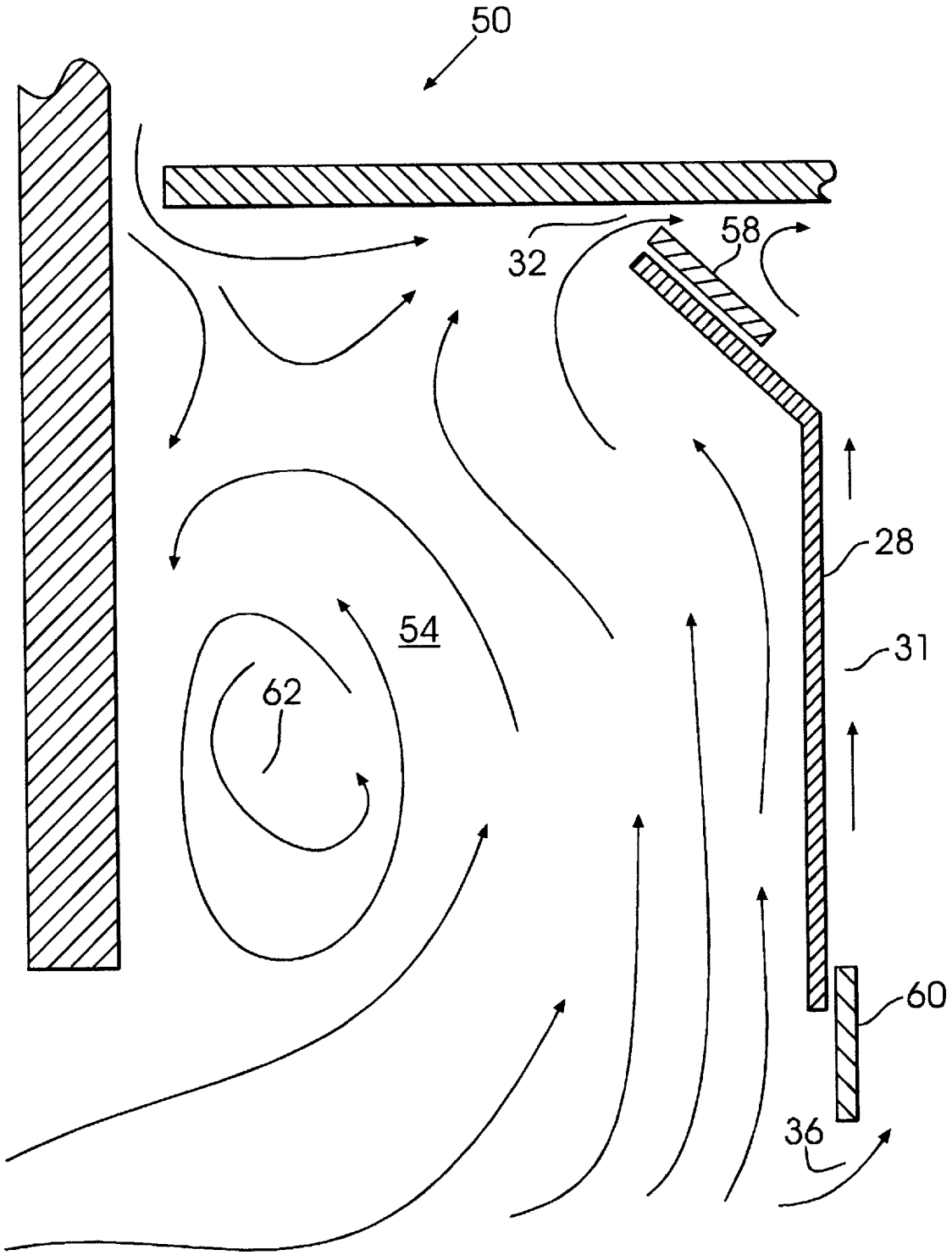

FIG. 4 is a schematic diagram of the upper portion of a fume hood showing the upper region of the vortex chamber and the vortex bubble formed by the flow therein.

Figure 5:
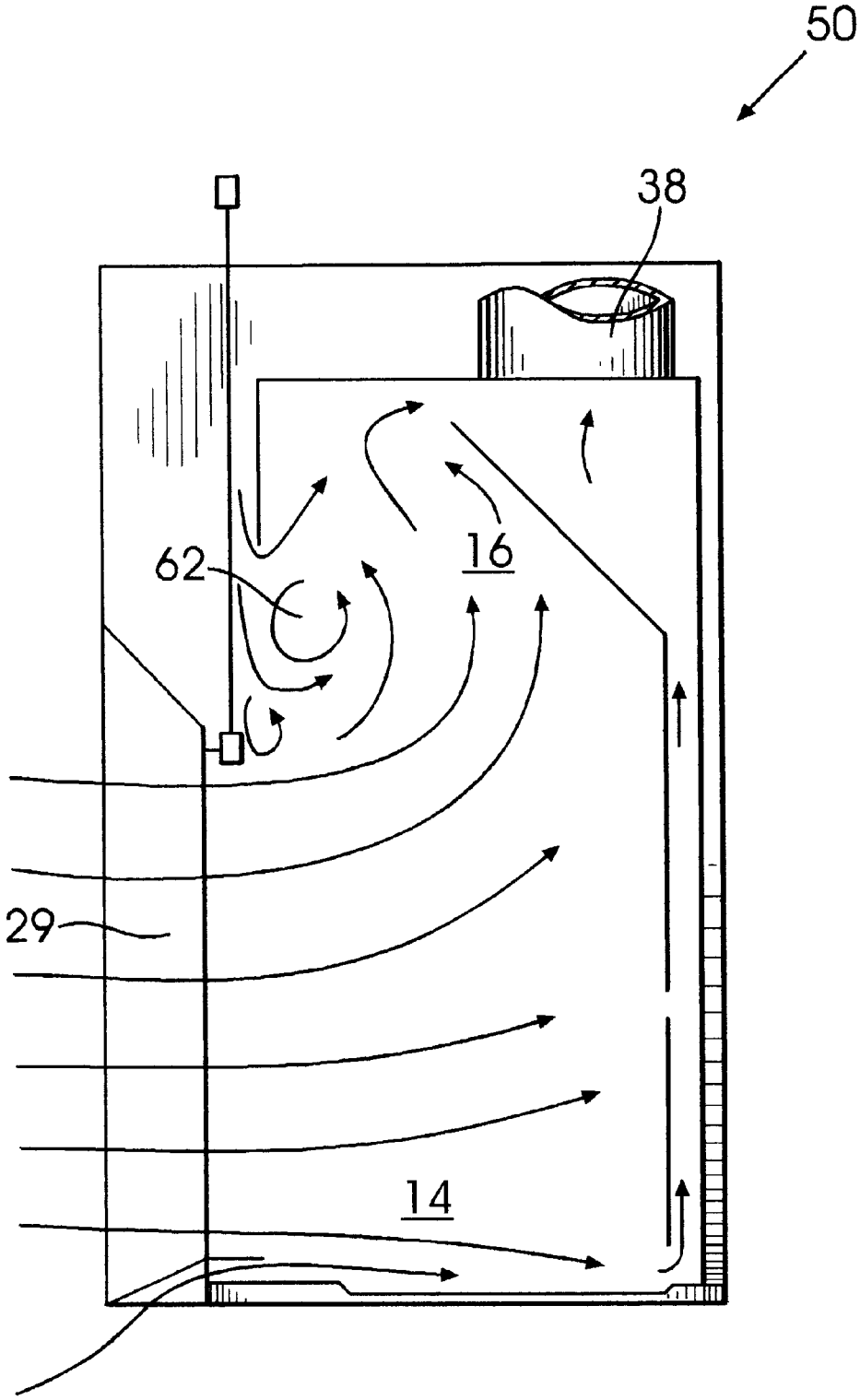

FIG. 5 is a diagram similar to FIG. 1 showing the flow pattern which includes a mono-stable vortex in the vortex chamber thereof.

Figure 6:
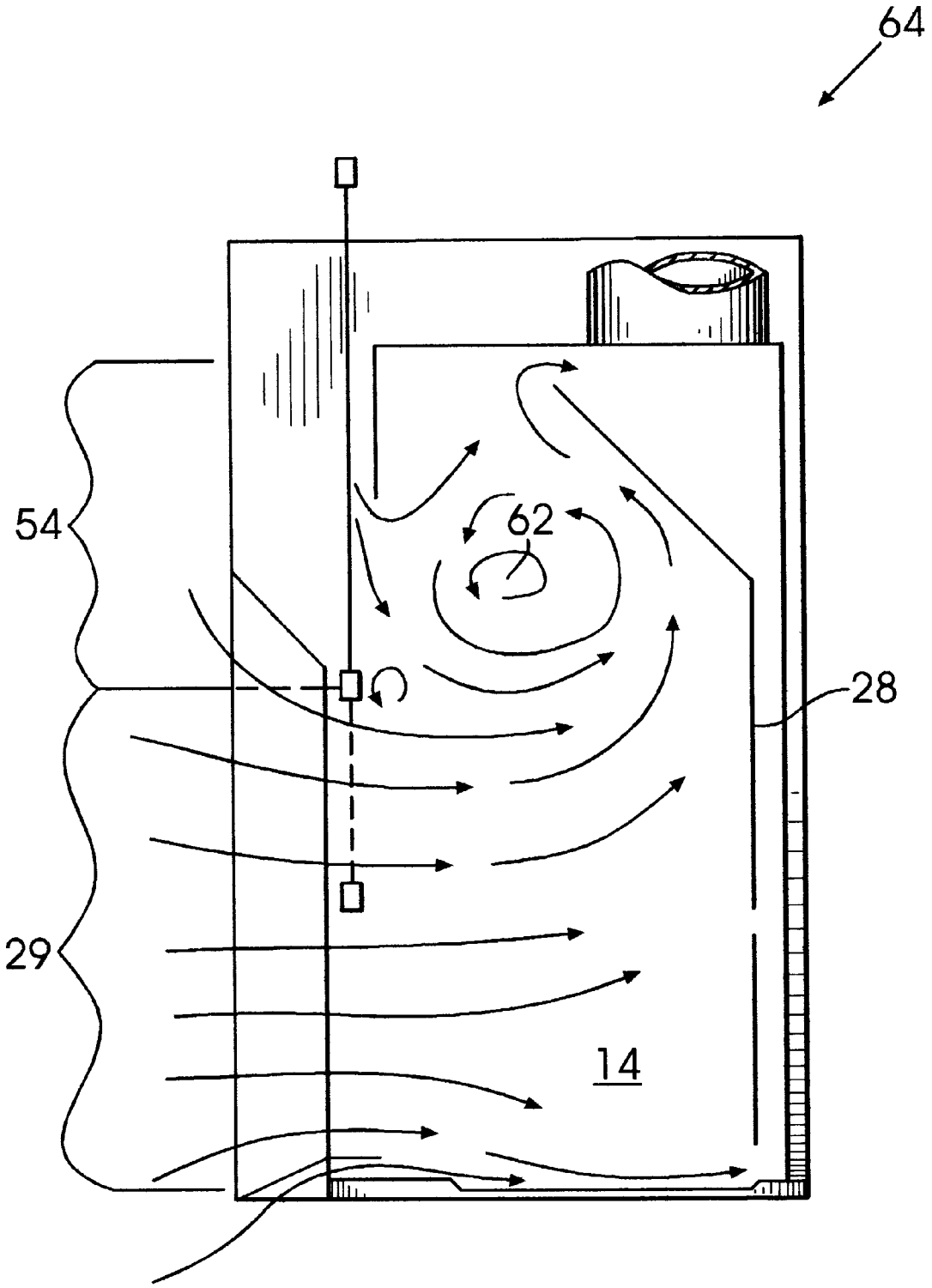

FIG. 6 is a schematic educational diagram of a fume hood and particularly the face velocity and vortex chambers thereof and having a bi-stable vortex, all in accordance with the present invention.

Figure 7:
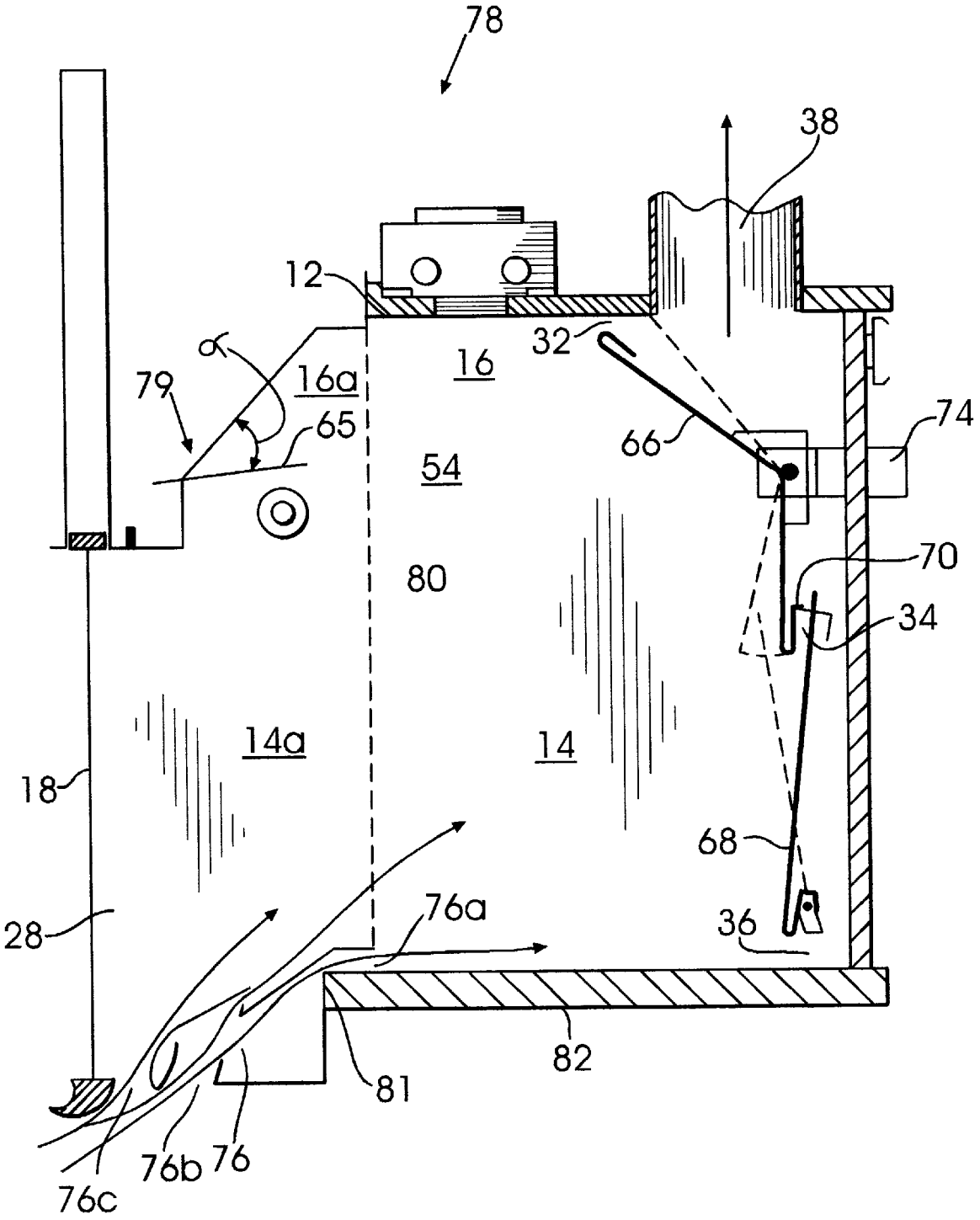

FIG. 7 is a schematic diagram showing a bi-stable vortex fume hood and the components thereof which provide the bi-stable vortex.

Figure 8:
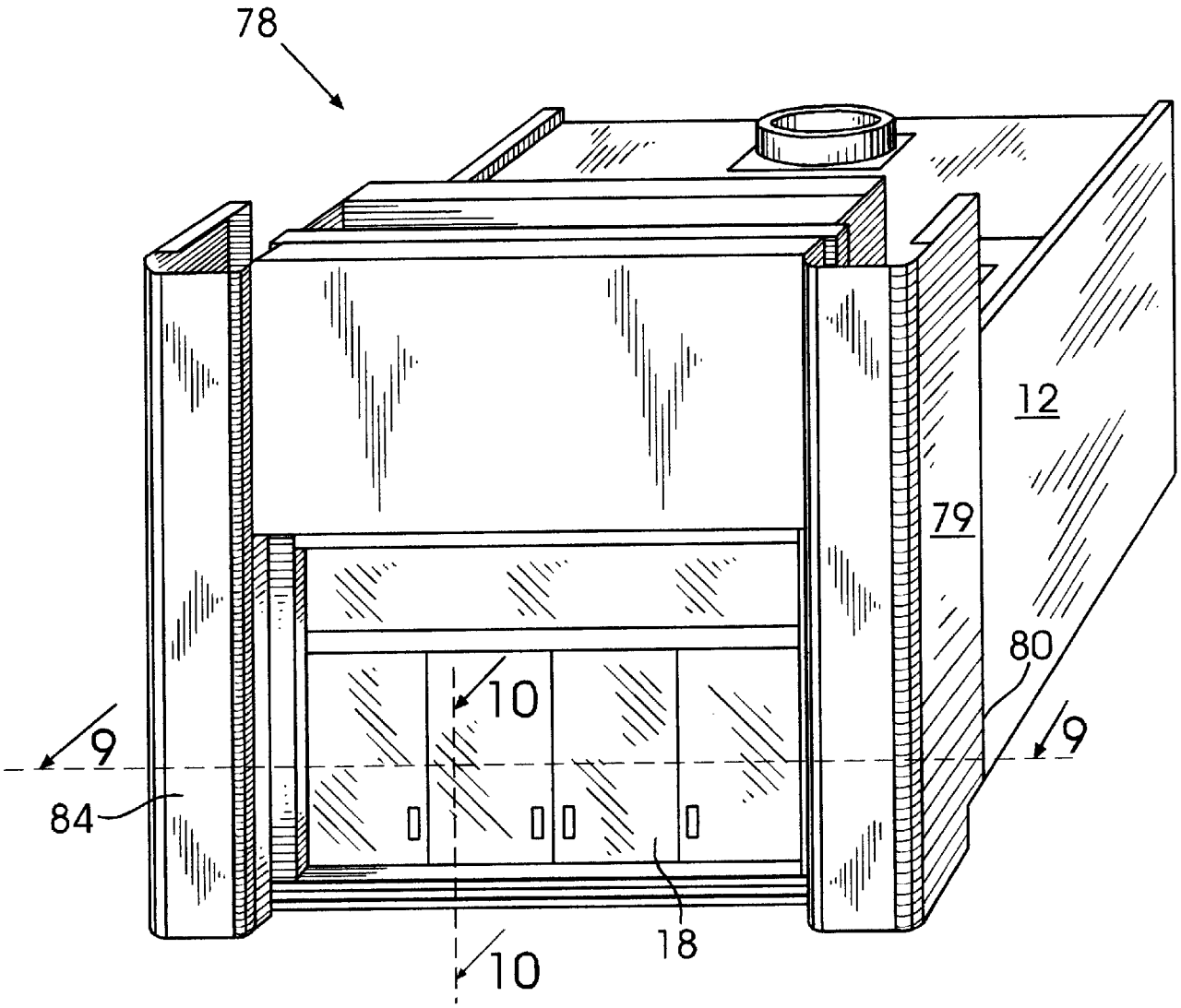
Figure 9A:
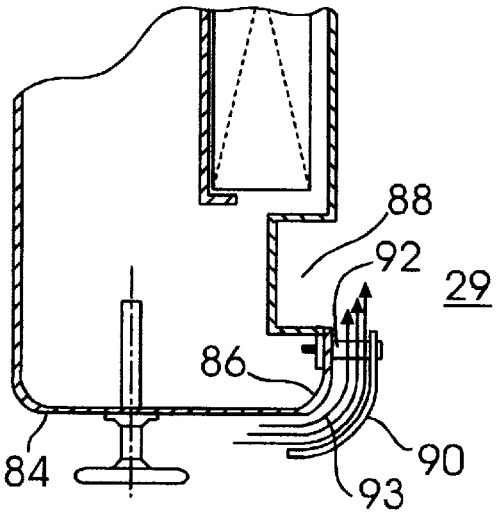
Figure 9B:
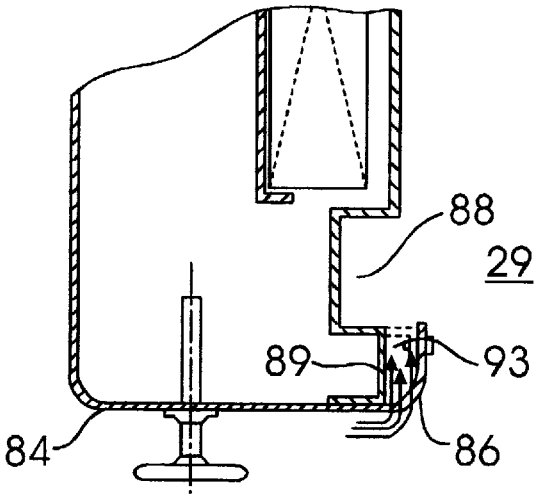
Figure 10:
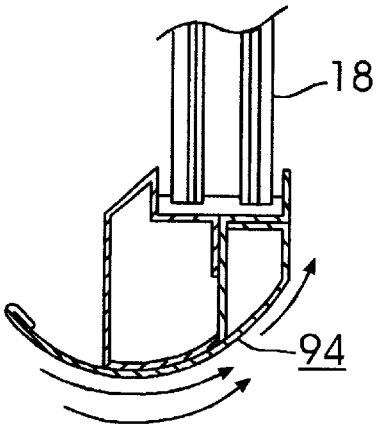

FIG. 8 is a perspective view of the fume hood shown in FIG. 7 and which has a front section containing the sash and its operating hardware;

FIGS. 9*a* and 9*b* are, respectively, fragmentary cross-sectional views taken along a horizontal plane, including 9—9 in FIG. 8, and showing alternative embodiments for aerodynamic shaping of the sash posts; and FIG. 10 is a fragmentary cross-sectional view taken along a vertical plane including line 10—10 in FIG. 8, showing an aerodynamic shaped sash handle used as a turning vane.

Referring to FIG. 1, a prior art fume hood 10 has an enclosure 12 containing a working space 14 having a floor 15, a head space 16 generally above working space 14, a vertically-slidable sash window or door 18 having seals 20 along its top and bottom edges, an airfoil 22 defining a bottom stop for sash 18 and a floor sweep entry 24 for admission of make-up air 26 when sash 18 is closed. When sash 18 is open, air 27 is drawn into enclosure 12 through the sash opening 29. Within enclosure 12 is a baffle 28 off-spaced from the back wall 30 of enclosure 12 to form plenum 31 and having upper 32, middle 34, and lower 36 transverse slots therein for admission of air to plenum 31. Plenum 31 communicates with an exhaust duct 38 leading to an exhaust fan (not shown).

Figure 2:
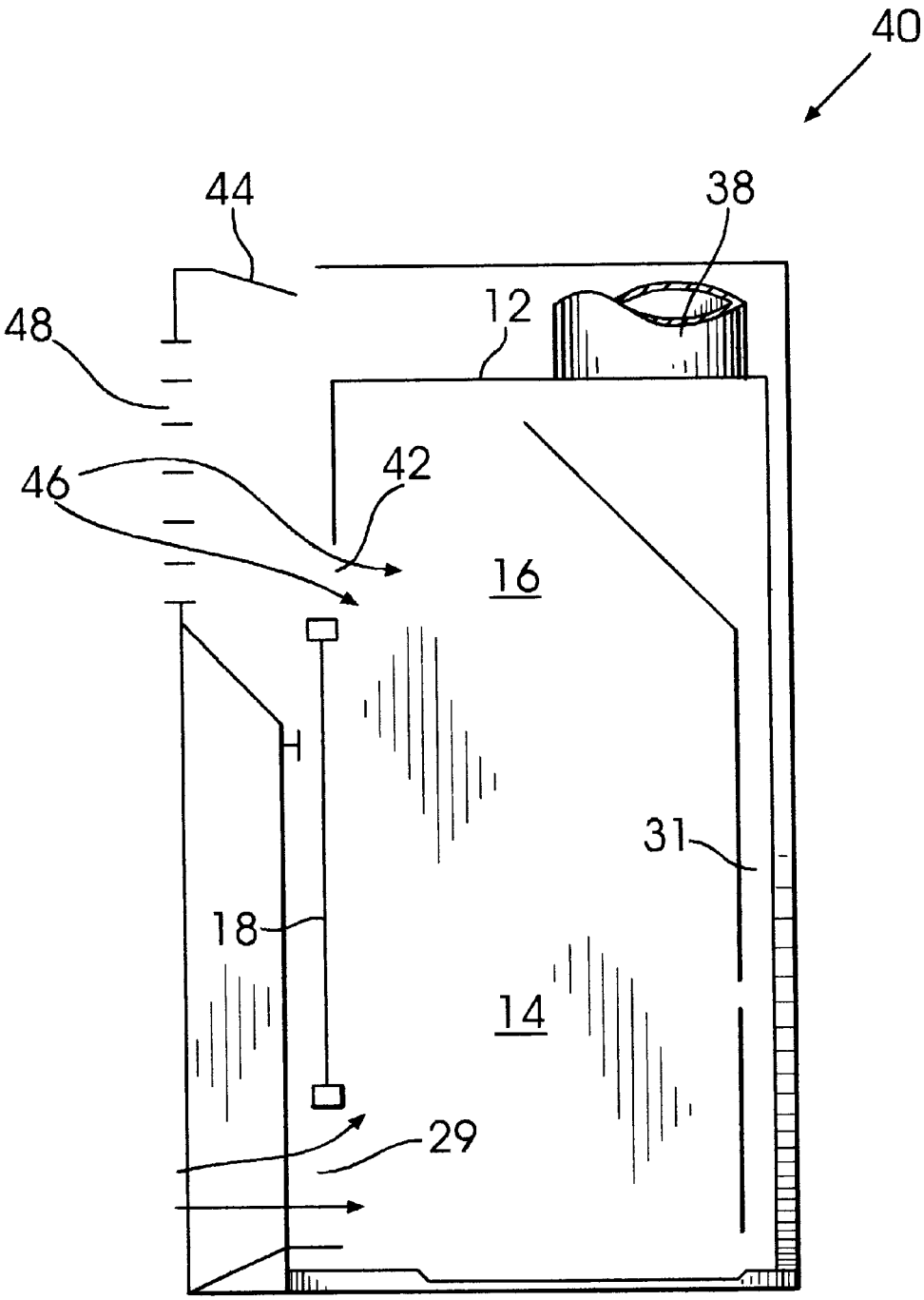
FIG. 2 (PRIOR ART)
FIG. 2 is a diagram similar to FIG. 1 of a Prior Art by-pass fume hood.

Referring to FIG. 2, another embodiment 40 of a prior art fume hood provides for essentially constant flow of air to the hood exhaust by opening an air bypass port 42 equal in area to the gain or loss in area of sash opening 29 as sash 18 is opened or closed, respectively. A bypass baffle 44 can be variably opened or closed to moderate the velocity of secondary make-up air 46 entering head space 16 through grille 48.

Referring to FIGS. 3 through 5, a fume hood 50 has a mono-stable vortex control system in accordance with the invention of the incorporated reference, U.S. Pat. No. 5,697,838. A vortex sensor 52 mounted in an opening through the sidewall of the headspace 16, which now includes vortex chamber 54, continuously measures the pressure difference between the vortex chamber and the exterior of hood 50 and causes a controller 56 to vary the position of dampers 58 and 60, which control the open areas of slots 32 and 36, respectively, until a stable vortex 62 is achieved as indicated by a minimum variation in the pressure difference being measured by sensor 52. As described in the reference, this system can maintain a laminar flow of air into working space 14 while sash opening 29 is varied as the sash is opened or closed.

Referring to FIG. 6, there is shown a fume hood 64 of typical sash height and linear length. These dimensions of course will vary depending upon the user's need. The hood vortex 62 is made bi-stable in accordance with the invention. The bi-stable vortex is maintained by using the following relationship for the hydraulic radius of the open sash 29 window area versus the hydraulic radius which will be required in the vortex chamber 54 above working chamber 14. (Eq. 1 below). These relationships are (a) the hydraulic radius of the vortex chamber is between about 80% and about 90% of the hydraulic radius of the open sash window, (hydraulic radius ratio is between 0.80 and 0.90) and (b) that the vertical component (height) of the vortex chamber is between about 80% and about 85% of the maximum height of the sash window opening. By using the hydraulic radius ratio relationship formula (Equation 1, below), the optimum depth of the hood can be determined for each and every fume hood sash opening, using Eq. 2.

$$\text{HYDRAULIC RADIUS RATIO} = \frac{\text{HYDRAULIC RADIUS VORTEX CHAMBER}}{\text{HYDRAULIC RADIUS OPEN SASH}} \quad \text{(Eq. 1)}$$

$$\text{Hydraulic radius of vortex chamber or sash} = \sqrt{(4a/p)} \quad \text{(Eq. 2)}$$

where a=the open window area or the cross-sectional area of the vortex chamber in a place perpendicular to the sash, and p=the open window perimeter or the perimeter of a cross section of the vortex chamber in a plane perpendicular to the sash.

These dimensional sizes and relationship to the open face area will provide the envelope required in order to develop a bi-stable vortex within the fume hood enclosure. A turning vane 65, shown in FIG. 7, can be a useful adjunct, and its included angle $\alpha$ should be between about 30° and about 45°. The turning vane may be about one half the height of the vortex chamber dimension. These relationships with the vortex chamber are features of the present invention.

A fume hood is most sensitive to environmental challenges when the sash 18 is fully opened and the vortex chamber 54 is at its smallest. The automatic vortex control system shown in FIG. 3 senses the vortex and repositions the back baffle system as described above to compensate for variations in equipment loading and space pressure, cross-drafts, activity in front of the hood, and the like. A bi-stable vortex baffle system in accordance with the invention further includes upper and lower interlocking or hinged, actuable baffles 66 and 68, respectively, which replace fixed baffle 28 in the prior art design, as shown in FIG. 7. Baffles 66 and 68 are each pivotable about a horizontal axis, the upper end 70 of baffle 68 being keyed and slaved to the lower end of baffle 66, middle slot 34 being formed therebetween. Upper slot 32 is formed at the top of baffle 66, and lower slot 36 is formed at the bottom end 72 of baffle 68. An actuator 74 is operationally disposed to turn baffle 66, and by slave extension baffle 68, in counter directions about their axes to vary simultaneously the size of the three slots and the geometry of the working chamber 14 and the vortex chamber 54.

In operation, as sash 18 is lowered, the closed loop vortex control system energizes actuator 74 to rotate baffle 66 clockwise which tends to close the upper slot and while doing so cantilevers the center slot towards the sash, thereby inducing a clearing action in working chamber 14. This feature is extremely important, as in a mono-stable hood the working chamber can become loaded with fumes which would otherwise tend to collect and spill out toward an operator as the sash is raised. The action of the baffle system also moves the bi-stable vortex bubble further from the sash window as it turns along the work surface (compare the position of vortex 62 in FIG. 5, mono-stable location, vs. FIG. 6, bi-stable location). This clearing action is enhanced by the laminar flow of air into the hood through airfoil 76 below the sash opening. Preferably, airfoil 76 is mounted in the floor of the working chamber just inside the sash opening and has a multiple (three) slot configuration, the top and center slots 76*a* and *b* directing air toward the center baffle slot 34 and a third slot 76*c* directing air along the floor of the working chamber toward lower baffle slot 36, as shown in FIG. 7.

In some applications particularly extremely mono-stable vortex fume hoods, it is possible to configure the hood for open loop control without involvement of a vortex sensor and vortex control system, wherein the action and position of the actuable baffles can be synchronized by trial and error to the position and movement of the sash through known electrical means such as a potentiometer or known mechanical means such as pulleys, gears, and the like. This less sophisticated open loop control method can provide improved hood performance, for example, to an existing prior art hood at lower cost than a fully closed loop control system.

In a preferred embodiment of a hood in accordance with the invention, a hood assembly 78, shown in FIGS. 7 and 8, comprises a conventional working chamber 14 and head space 16 but also includes an additional forward hood portion 79 which may be attached to the front of a conventional hood enclosure 12 along line 80, either in a newly constructed hood or in a retrofit of an existing hood. By constructing a fume hood in this way, a quick and easy assembly can be made in the field. Assembly 78 is shown as a bench-mounted hood, although larger, floor-mounted, walk-in embodiments are within the scope of the invention. An advantage of hood assembly 78 is that it extends substantially forward of the edge 81 of bench 82, permitting the placement of airfoil 76 behind the lower edge of sash opening 29 and within the bottom of the hood. Forward portion 79 includes additional working space 14*a* and head space 16*a,* making those chambers deeper which can improve the geometrical relationships consistent with Equation 1. The removable portion 79 enables a bi-stable vortex fume hood to be not limited to a size which would normally be able to fit through a standard doorway or easily placed on a lab bench. A fume hood which can be assembled in the field to be larger than a conventional mono-stable vortex hood is still another feature of the invention.

An important objective in the design and operation of efficient, non-spilling hoods is maximizing laminar airflow in all regions of the hood and minimizing turbulence. FIGS. 9*a,* 9*b,* and 10 show desirable laminar-flow-promoting features relating to the sash opening.

In FIG. 9*a,* left hood post 84 has a radiused corner 86 to the entrance to sash opening 29 and is provided immediately outside of sash channel 88 with an off-spaced airfoil vane 90 mounted on spacers 92 bolted to post 84 to form an open-ended plenum 93 between the vane and the post. Vane 90 extends preferably over the entire height of sash opening 29. In practice, a mirror image vane installation is also provided for the right hood post.

FIG. 9*b* shows an alternative embodiment to the configuration of FIG. 9*a.* wherein corner 86 is perforated or slotted to permit passage of air and sash channel 88 is reconfigured with flange 89 to form air plenum 93.

FIG. 10 shows an aerodynamic handle 94 which extends preferably the full width of the bottom of sash 18 and provides laminar air flow across the lower edge of the sash when the sash is not fully closed, and an aerodynamic surface for top slot of the airfoil when the sash is fully closed.

From the foregoing description it will be apparent that there has been provided an improved fume hood, wherein an actuable, articulated baffle and a vortex control system provide a head space vortex which is bi-stable. Variations and modifications of the herein described fume hood, in accordance with the invention, will undoubtedly suggest themselves to those skilled in this art. Accordingly, the foregoing description should be taken as illustrative and not in a limiting sense.

What is claimed is:

1. A fume hood having a chamber with a movable sash operable in a sash opening along a front side thereof, a pivotable baffle within said chamber, an airfoil for direction of air flow into said chamber toward said baffle, and means for pivoting said pivotable baffle to maintain a bi-stable vortex within said chamber.

2. A hood in accordance with claim 1 wherein said means for moving includes a vortex sensing system.

3. A hood in accordance with claim 1 wherein said means for moving includes means for synchronizing the movement of said pivotable baffle with movement of said sash in said sash opening.

4. A hood in accordance with claim 1 wherein said pivotable baffle includes an upper and a lower baffle, said baffles being conjointly hinged to define a slot therebetween.

5. A hood in accordance with claim 4 wherein said airfoil is disposed in a bottom portion of said chamber.

6. A hood in accordance with claim 5 wherein said airfoil includes a plurality of slots including top and center slots for directing air toward said hinge joint and a third slot for directing air along the floor of said chamber.

7. A hood in accordance with claim 1 wherein said hood has separable front and back sections, said front section including said sash and means for operation thereof.

8. A hood in accordance with claim 1 wherein said chamber includes a vortex chamber wherein the ratio of the hydraulic radius of said vortex chamber to the hydraulic radius of said sash opening when said sash is fully open is in the range from about 0.8 to about 0.9 and wherein the vertical height of said vortex chamber is in the range of about 0.8 to about 0.85 of the height of said sash opening when said sash is fully open.

9. A hood in accordance with claim 8 wherein said hydraulic radius of said vortex chamber is equal to $\sqrt{(4a/p)}$, where a=the area of a cross section of said chamber perpendicular to the plane of said sash opening and p=the perimeter of said cross section of said chamber and wherein said hydraulic radius of said sash opening is equal to $\sqrt{(4a/p)}$, where a=the area of said opening when said sash is fully open and p=the perimeter of said opening.

10. A hood in accordance with claim 8 further comprising an adjustable turning vane within said hood chamber.

11. A hood in accordance with claim 10 wherein said turning vane is disposed at an angle of between about 30° and about 45° to a wall of said chamber.

12. A hood in accordance with claim 10 wherein the height of said turning vane is about one-half the height of said vortex chamber.

13. A hood in accordance with claim 1 wherein said sash opening is provided with airfoils along the left and right sides of said opening.

14. A hood in accordance with claim 1 wherein said sash is provided with a handle having an airfoil along a lower edge thereof.

* * * * *